US006591990B2

(12) United States Patent
Lanman et al.

(10) Patent No.: US 6,591,990 B2
(45) Date of Patent: Jul. 15, 2003

(54) DESK ORGANIZER

(75) Inventors: John Lanman, Naperville, IL (US); John Bergeron, Barrington, IL (US)

(73) Assignee: Thermos L.L.C., Barrington, IL (US)

( * ) Notice: Subject to any disclaimer, the term of this patent is extended or adjusted under 35 U.S.C. 154(b) by 0 days.

(21) Appl. No.: 09/902,303

(22) Filed: Jul. 10, 2001

(65) Prior Publication Data

US 2003/0010728 A1 Jan. 16, 2003

(51) Int. Cl.[7] ..... B42F 17/00

(52) U.S. Cl. ..... 211/10; D19/78; 211/69.1; 211/126.1; 206/214; 206/224; 206/371

(58) Field of Search ..... 211/10, 11, 13.1, 211/69.1–69.9, 163, 126.1, 126.13, 126.14, 133.6; 206/214, 224, 371, 557, 565, 564, 561, 562, 563; D19/35, 36, 65, 75, 77–79, 81–85, 86, 92, 93, 95, 99, 100; 220/500, 507, 23.88, 516

(56) References Cited

U.S. PATENT DOCUMENTS

| | | | | | |
|---|---|---|---|---|---|
| D119,890 | S | * | 4/1940 | Marcantonio | D19/77 |
| D173,818 | S | * | 1/1955 | Rogers | D19/70 |
| D181,245 | S | * | 10/1957 | Boker | D19/69 |
| D266,435 | S | * | 10/1982 | Laughlin | D19/75 |
| D296,568 | S | * | 7/1988 | Nadeau | D19/77 |
| 4,754,883 | A | * | 7/1988 | Grzywa | 224/400 |
| 4,802,593 | A | * | 2/1989 | Romanos | 211/10 |
| D317,461 | S | * | 6/1991 | Willie | D19/75 |
| D332,968 | S | * | 2/1993 | Peersmann | D19/75 |
| D333,841 | S | * | 3/1993 | Henricksen | D19/75 |
| D335,307 | S | * | 5/1993 | Brussing | D19/75 |
| D342,095 | S | * | 12/1993 | Peersmann | D19/77 |
| D342,758 | S | * | 12/1993 | Kirchhoff et al. | D19/69 |
| D352,068 | S | * | 11/1994 | Adams | D19/78 |
| D354,310 | S | * | 1/1995 | Crist et al. | D19/75 |
| D355,217 | S | * | 2/1995 | Luna | D19/78 |
| D357,034 | S | * | 4/1995 | King | D19/77 |
| D361,598 | S | * | 8/1995 | Adams | D19/77 |
| D372,938 | S | * | 8/1996 | Wilson et al. | D19/69 |
| D379,435 | S | * | 5/1997 | Hsu | D10/2 |
| D385,920 | S | * | 11/1997 | Tisbo | D19/75 |
| D391,295 | S | * | 2/1998 | Kocon et al. | D19/35 |
| D414,808 | S | * | 10/1999 | Hunt | D19/69 |
| D428,923 | S | * | 8/2000 | McDiarmid | D19/77 |
| D431,264 | S | * | 9/2000 | Tsuei | D19/77 |
| D432,577 | S | * | 10/2000 | Yeh | D19/77 |
| 6,138,831 | A | * | 10/2000 | Agostinelli | 206/541 |
| 6,279,753 | B1 | * | 8/2001 | Swanson | 211/1.51 |
| D456,451 | S | * | 4/2002 | Slater et al. | D19/78 |
| D457,191 | S | * | 5/2002 | Slater et al. | D19/78 |
| D457,566 | S | * | 5/2002 | Slater et al. | D19/77 |
| D469,126 | S | * | 1/2003 | Joss et al. | D19/75 |
| D469,810 | S | * | 2/2003 | Joss et al. | D19/75 |

* cited by examiner

*Primary Examiner*—Daniel P. Stodola
*Assistant Examiner*—Jennifer E. Novosad
(74) *Attorney, Agent, or Firm*—Wood, Phillips, Katz, Clark & Mortimer

(57) ABSTRACT

A highly functional desk organizer includes a base (10) with a bottom surface (12) and a top surface (16), (108) with a thickness that is relatively small in relation to the periphery of the base (10). An array of three pockets (26), (28), (30); (110), (112), (114) is located on the top surface (16), (108) that includes a relatively shallow pocket (28), (112) in the center of the array and is adapted to receive and provide support for a note pad, and the two side pockets (26), (30); (110), (114) on each side of the central pocket (28), (112) which are deeper than the central pocket (28), (112) and adapted to receive paper clips, rubber bands, business cards or the like. Two cylindrical pockets (32), (34); (116), (118) are located in the top surface (108) and are substantially identical and relatively deep in relation to the central pocket (28), (112). A pen or pencil holder (36), (120) is sized to be received in either of the pockets (32), (34); (116), (118) and an upright beverage container (42), (130) is likewise sized to nest in either one of the cylindrical pockets (32), (34); (116), (118).

13 Claims, 4 Drawing Sheets

DESK ORGANIZER

FIELD OF THE INVENTION

This invention relates to desk organizers, that is, accessories for placement on a desk for holding, in separate locations that are easily utilizable by a person working at a desk, various items such as paper clips, rubber bands, pen and pencil holders.

BACKGROUND OF THE INVENTION

Workers who perform their jobs at least part of the time at desks, tables or the like typically require the use of various articles in performing their jobs. By way of example, such a worker may require ready access to such things as paper clips, rubber bands, business cards, note pads or so-called "stickies", marking instruments such as pens, pencils and other sorts of markers. In addition, many such workers sip beverages of one sort or another as they perform their duties.

In order that the duties of the worker be performed as efficiently as possible, it is highly desirable to provide a means of organizing such items so that they are readily accessible to the user without requiring the user to literally hunt for the particular item sought. This factor has led to the development of so-called desk organizers which attempt to provide locations for receipt of each of the various types of items that may be used during a work day.

One example of a desk organizer includes a flat base provided with bales for impaling the pages of a daily calendar, a holder for a note pad and a holder for a single writing instrument. This type of construction suffers several disadvantages in that no provision is made for storage of paper clips, business cards, rubber bands or a plurality of writing instruments. Consequently, if such additional items are to be stored, one or more separate pieces of equipment are required. This leads to inefficiencies if the desk organizer and such separate pieces of equipment as may be required are moved relative to each other and become separated. Furthermore, such a desk organizer lacks provision for receipt of a beverage holder such as a travel mug, a glass or a coffee mug, thereby requiring the user to resort to a separate coaster if damage to the surface of the desk or table top is to be avoided.

Furthermore, in many instances, workers provide a means for display of pictures or the like in separate holders and have frequent resort to a time piece which may or may not be readily viewable.

In some instances, workers have need to have ready access to envelopes or the like and these must be stored at locations separate and independent of the desk organizer.

The present invention is directed to overcoming one or more of the above problems.

SUMMARY OF THE INVENTION

It is the principal object of the invention to provide a new and improved desk organizer. More specifically, it is an object of the invention to provide a desk organizer that is a single accessory that includes provision for storage with ready accessibility for a multitude of items commonly found in the environment of a desk and used by a worker at the desk.

An exemplary embodiment of the invention achieves the foregoing in a desk organizer that includes a base having a bottom surface adapted to rest on a table like surface, an opposite top surface, and a thickness that is relatively small in relation to the periphery of the base, a front wall, a rear wall, and spaced, opposed side walls extending between the front and rear walls. An array of at least two pockets in the top surface adjacent the front wall includes a rectangular, relatively shallow pocket adapted to receive and provide support for a note pad and a relatively deeper pocket on one side of the shallow pocket and adapted to receive paper clips, rubber bands, business cards or the like. At least two cylindrical pockets are provided in the top surface and each is adjacent a respective one of the side walls. The cylindrical pockets are substantially identical to each other and relatively deep in relation to the shallow pocket. An upright, open topped container is adapted to receive marking devices such as pens and pencils and has a cylindrical bottom sized to nest in either one of the cylindrical pockets and is located in a selected one of the cylindrical pockets. An upright beverage container is provided and has an open top and a cylindrical bottom sized to nest in either one of the cylindrical pockets and is located in the other one of the cylindrical pockets.

As a consequence, the desk holder provides locations for the receipt of at least four different items commonly encountered in a working environment requiring the use of a desk or table like surface thereby providing a far greater degree of organization in a single structure than has heretofore been known.

In a preferred embodiment, the array of pockets includes at least three pockets and the relatively shallow pocket is in the center of the array. There are two side pockets, one on each side of the central pocket and both side pockets are deeper than the central pockets.

In one embodiment, the pockets in the array and the cylindrical pockets define a row with one of the cylindrical pockets being at each end of the array.

The invention contemplates that in this embodiment, an upright display panel is disposed between the central pocket and the rear wall and extends upwardly from the base and is adapted to mount an article to be displayed such as a photograph or a time piece.

In another embodiment of the invention, each of the cylindrical pockets is located between a corresponding one of the side pockets in the array and the rear wall.

In this embodiment, the desk organizer may include an open topped, pigeon hole bin extending upwardly from the top surface and located between the cylindrical pockets on the one hand and the central pocket and the rear wall on the other hand.

In one embodiment, the open topped bin includes front and rear walls and side walls extending between the front and rear walls. The bin side walls are concave in facing relation to the cylindrical pockets to thereby facilitate compactness of the desk organizer.

Other objects and advantages will become apparent from the following specification taken in connection with the accompanying drawings.

DESCRIPTION OF THE PREFERRED EMBODIMENTS

Figure 1:
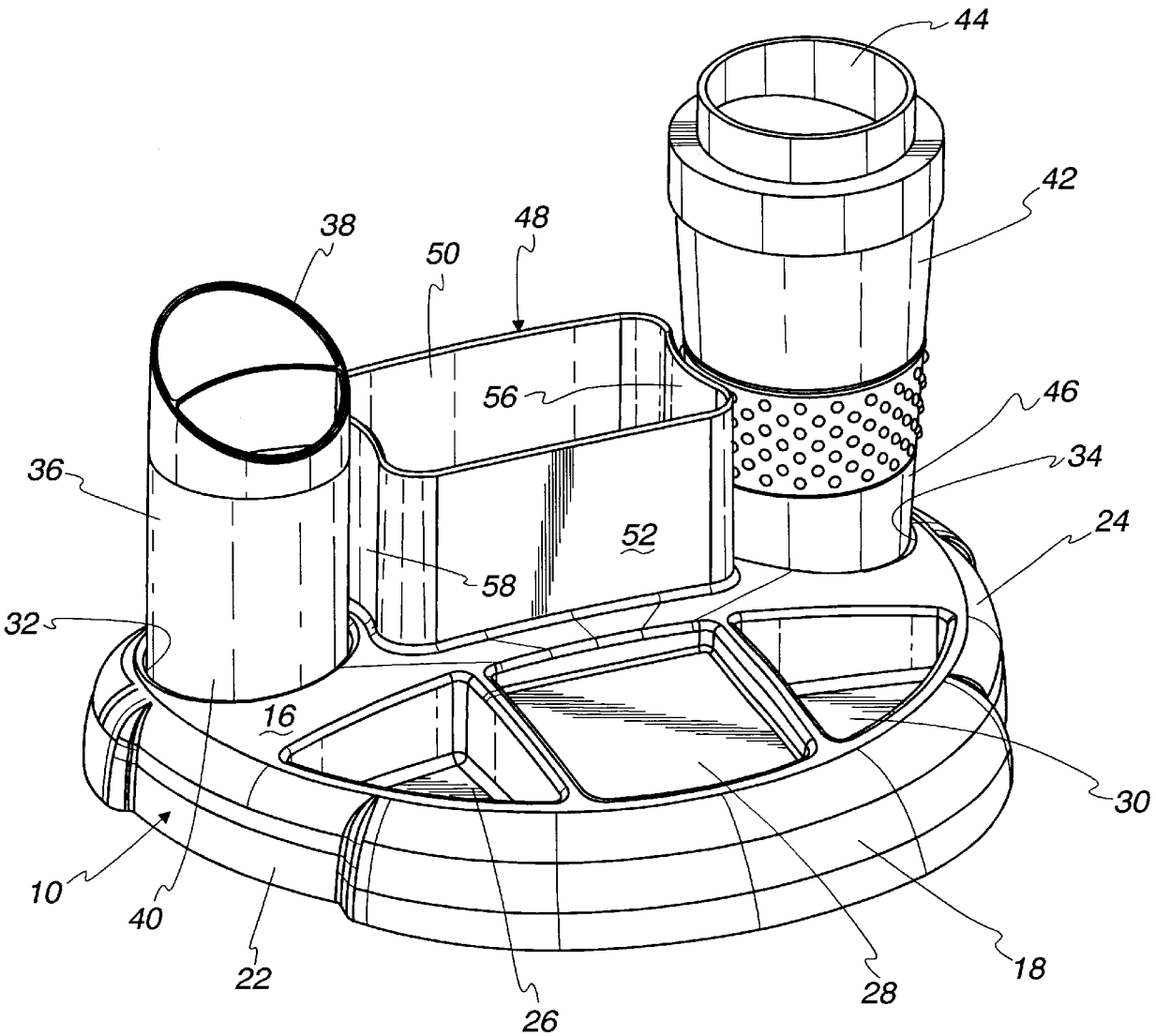
FIG. 1 is a perspective view of a desk organizer made according to the invention taken from the upper left front thereof.
Figure 2:
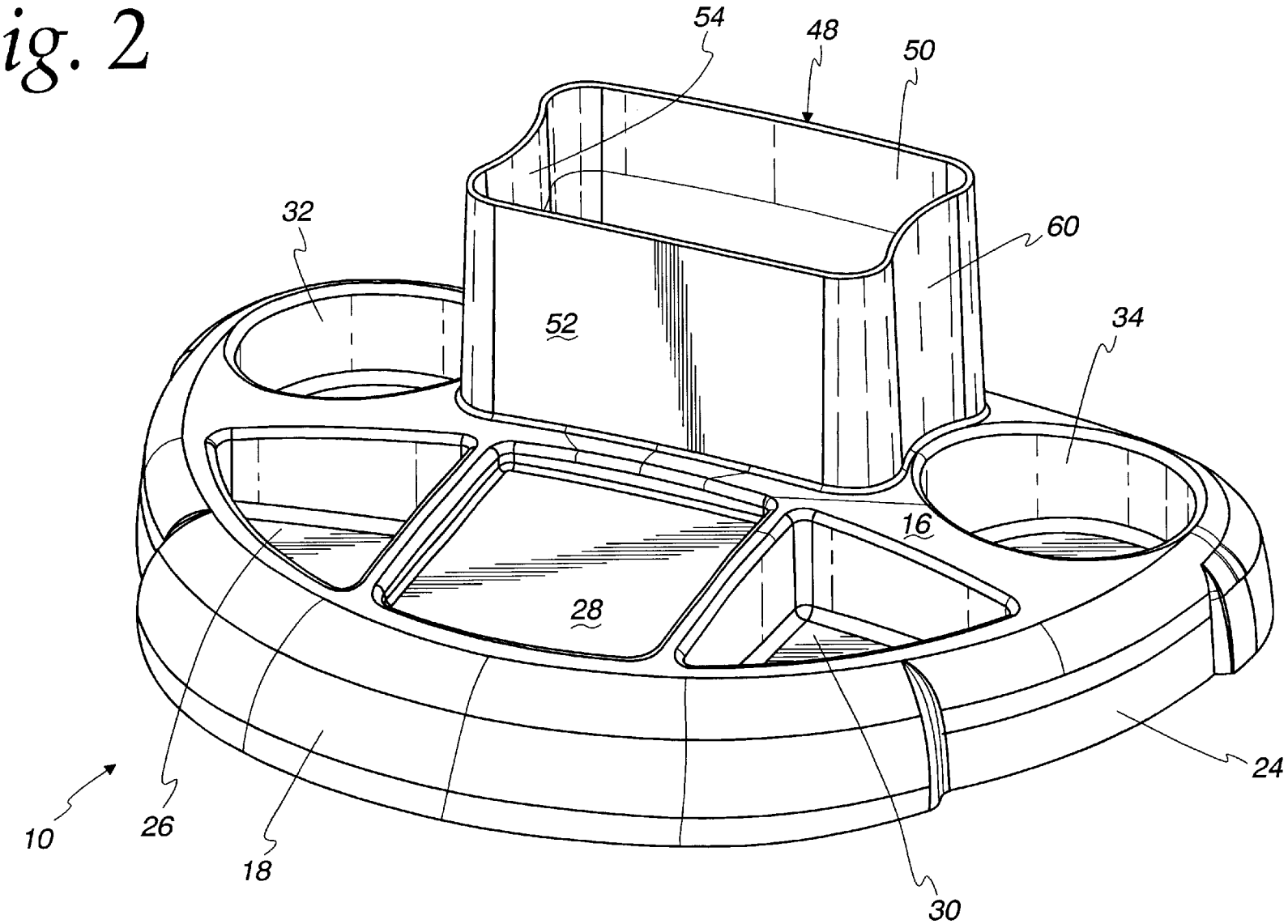
FIG. 2 is a further perspective view of the desk organizer of FIG. 1 but with a pen and pencil holder and a beverage holder removed therefrom and taken from the upper right front of the desk organizer.
Figure 3:
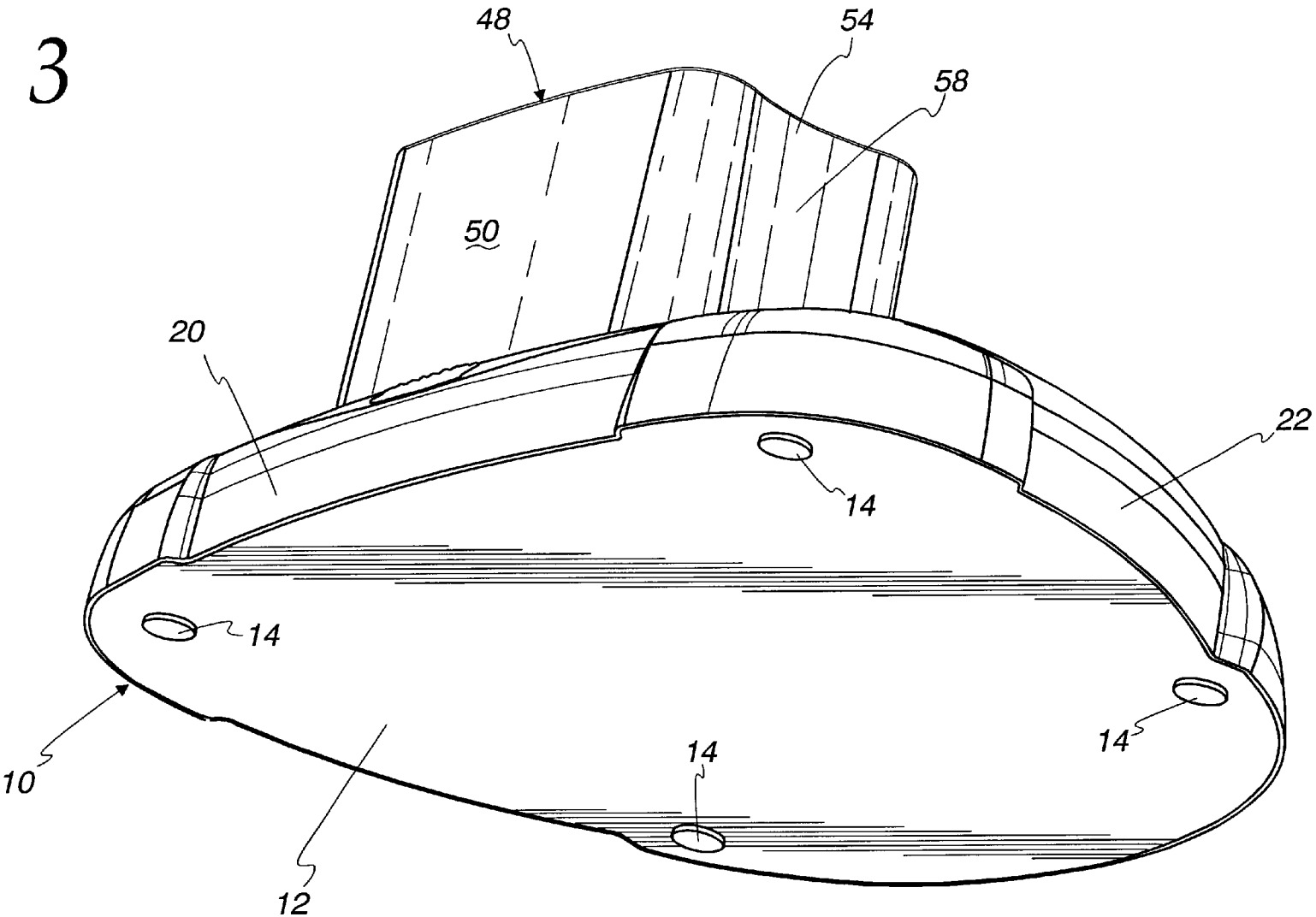
FIG. 3 is still another perspective of the embodiment illustrated in FIGS. 1 and 2 and is taken from the bottom, left rear of the desk organizer.

One exemplary embodiment of a desk organizer made according to the invention is illustrated in FIGS. 1–3, inclusive and with reference thereto, is seen to include a base, generally designated 10, that is adapted to rest on a desk or other table like surface. To this end, the base 10 includes a bottom 12 (FIG. 3) on which rubber or felt grommets 14 are located so that a decorative surface underlying the desk organizer will not be marred. As seen in FIGS. 1 and 2, the base 10 includes an upper surface 16 opposite the bottom surface 12. The bottom surface 12 and top surface 16 are connected by a front wall 18, a rear wall 20 (FIG. 3) and opposed side walls 22 and 24 which extend between the front and rear walls 18, 20 respectively.

As can be appreciated from FIGS. 1–3 inclusive, the base 10 is relatively shallow. That is to say, the distance between the bottom wall 12 and the top wall 16 is relatively small in comparison to the periphery of the desk organizer as defined by the front wall 18, rear wall 20, and side walls 22, 24. In a typical case, the overall thickness may be on the order of 2 inches.

Referring to FIGS. 1 and 2, adjacent the front wall 18, there is an array of three pockets 26, 28 and 30 formed in the top surface 16. In some instances a lesser number of pockets may be employed in the array. The pocket 28 is a central pocket and is generally rectangular in form. The pockets 26 and 30 are side pockets and are considerably deeper than the pocket 28. The pocket 28 is adapted to receive a note pad or a pad of so-called "stickies" and support the same in such a way that messages or notes may be inscribed on the pad without removing the same from the pocket 28. The pocket 28 is made shallow so that one need not have to inscribe notes on a pad therein at a location substantially below the upper surface 16, thereby enhancing the efficiency of the note making process.

The pockets 26 and 30 are generally triangular in shape, although any desired shape could be used so long as the pockets 26 and 30 remain within the confines of the base 10. Pockets 26 and 30 may hold paper clips, rubber bands, business cards or the like and their relatively greater depth is ideally suited to storing a considerable quantity of such items.

Two, cylindrical, relatively deep pockets 32 and 34 are also provided in the upper surface 16 as seen in FIG. 2. The pockets 32 and 34 will have a depth on the same order as the pockets 26 and 30 and are located such that the pocket 32 is adjacent the junction of the side wall 22 and the rear wall 20 while the pocket 34 is adjacent the junction of the side wall 24 and the rear wall 20. That is to say, the pocket 32 is between the pocket 26 and the rear wall 20 while the pocket 34 is located between the pocket 30 and the rear wall 20. The pockets 32 and 34 will be substantially identical, one to the other.

As seen in FIG. 1, the desk organizer includes a pen and pencil holder 36 having an open top 38. Other marking instruments may also be placed in the holder 36. The holder 36 has a cylindrical lower section 40 sized to be removably nested within the pocket 32 or the pocket 34.

Also included is a beverage holder 42 having an open top 44. As illustrated, the beverage holder 42 may be of the type frequently referred to as a travel mug and will have an insulated wall. The lower end 46 of the beverage container 42 will also be generally cylindrical (or possibly mildly frusto-conical) and is sized to be received in either one of the pockets 32 or 34.

This arrangement provides for interchangeability of the location of the holder 36 and the beverage container 42 to suit the desires of the user of the desk organizer. That is to say, one user of the desk organizer may prefer to have the holder 36 on the left as viewed in FIG. 1 and the beverage container 42 on the right. However, another user may prefer to reverse that orientation; and the above-described arrangement provides for that.

Located between the pockets 32 and 34 on the one hand and the pocket 28 and the rear wall 20 on the other is an upstanding, generally rectangular, pigeon hole bin, generally designated 48. The pigeon hole bin extends upwardly from the surface 16 and includes a rear wall 50, a front wall 52 and opposed side walls 54 (FIG. 2) and 56 (FIG. 1). The side walls 54 and 56 extend between and interconnect the rear wall 50 and the front wall 52.

It is to be particularly observed that while the pigeon hole bin 48 is generally rectangular, both side walls 54 and 56 are somewhat concave as shown at 58 in FIG. 1 and 60 at FIG. 2 for the side walls 54 and 56, respectively. The concavities 58 face corresponding ones of the cylindrical pockets 32 and 34 and allow the side walls 54 and 56 to be closely adjacent the pockets 32 and 34 without obstructing access thereto. This construction minimizes the side to side dimension of the base 10 to provide for a great measure of compactness.

The pigeon hole bin 48 may be utilized to store such things as envelopes that are used in the course of the user performing his or her duties at the table like surface on which the desk organizer is placed. It may also be utilized to store mail requiring the attention of the user of the desk organizer as, for example, incoming bills or the like. And of course, the pigeon hole bin 48 may be utilized to hold any of a variety of desired items that are capable of fitting within the pigeon hole bin 48.

In a like vein, one or the other or both of the holder 36 and the beverage container 42 may be removed from the pockets 32 and 34 and the pockets 32 and 34 used for the storage of other items as well.

It is to be particularly noted that the pockets 26, 28 and 30 are adjacent the front wall 18 of the base 10 whereas the pockets 32 and 34 along with the bin 48 are to the rear thereof. This assures that the holder 36, the beverage container 42 or the bin 48 do not block ready access to the pockets 26, 28 and 30 because of the substantially greater height of the former.

Figure 4:
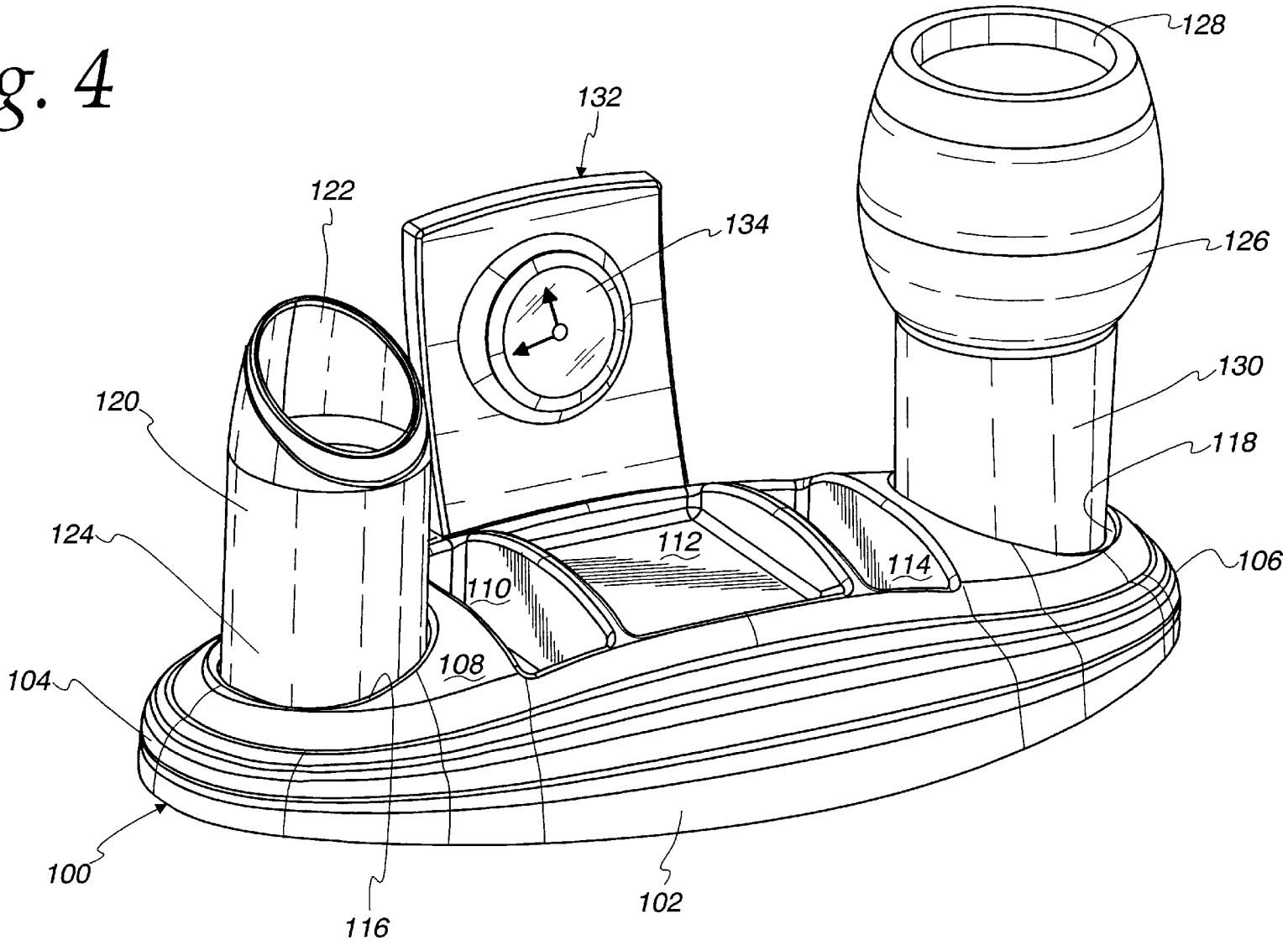
FIG. 4 is a view similar to FIG. 1 but of a modified embodiment of the invention.

FIG. 4 illustrates an alternative embodiment of the invention. Again, a base, generally designated 100, is provided and has a front wall 102, side walls 104, 106, and a rear wall not shown. The base 100 again is relatively thin in relation to the periphery of the base 10 and includes an upper surface 108 and a bottom surface not shown. An array of three pockets 110, 112 and 114 are provided in the upper surface 108, with the pocket 112 being a relatively shallow, central pocket and the pockets 110 and 114 being relatively deeper side pockets, one on each side of the central pocket 112. If desired, fewer than three pockets may be employed. The pockets 110, 112 and 114 provide functions that correspond to those previously described in connection with the description of the pockets 26, 28 and 30. A cylindrical pocket 116 is provided on one end of the array of the pockets 110, 112, 114 and an identical cylindrical pocket 118 is placed on the other end of that array to form a row of pockets. The pocket 116 is shown in FIG. 4 as containing a pen and pencil holder

120 having an open top 122 and a cylindrical bottom 124 sized to fit within the pocket 116. Again, a mug or other beverage holder 126 having an open top 128 is provided for the pocket 118. To this end, the beverage holder 126 has a cylindrical lower section 130 that is sized to snugly fit within cylindrical pocket 118. The arrangement is as described with the embodiment of FIGS. 1–3 and allows the holder 120 to be interchangeably located in either of the cylindrical pockets 116, 118 and allows similar interchangeability of the beverage container 126 in either of the pockets 116, 118.

A display panel, generally designated 132, extends upwardly from the upper surface 108 of the base 100 at a location between the central pocket 112 and the rear wall of the base. The display panel 132 is adapted to mount anything that the user of the desk organizer cares to place on it. As illustrated, the display panel 132 includes a time piece 134 so that the user may readily ascertain the time of day simply by looking at the desk organizer. At the same time, the display panel could display a photograph or tables of data that the user requires ready reference to in the course of performing his or her duties. Again, the location of the array of pockets 110, 112, 114 between the holder 120 and the beverage container 126 and forwardly of the display panel 132 provides for ready accessibility to the pockets 110, 112 and 114 so that access thereto will not be blocked by the relatively taller components of the desk organizer.

From the foregoing, it will be appreciated that a desk organizer made according to the invention provides a means of storage with ready accessibility to any of a large variety of items that the user may require access to in the course of performing his or her duties. It further provides a means of locating a beverage holder without the need of a separate coaster and without fear of damaging the underlying surface on which the desk organizer is supported. The invention provides for a maximum of storage of necessary items with a minimum of bulk and is susceptible to being configured in any of several attractive designs, including the two illustrated in the drawings. Thus, a desk organizer made according to the invention provides substantial advantages over those heretofore known.

We claim:

1. A desk organizer, comprising:

a base having a bottom surface adapted to rest on a generally horizontal surface, an opposite top surface, and a thickness that is relatively small in relation to the length of the periphery of the base, a front wall, a rear wall and spaced, opposed side walls extending between said front and rear walls;

an array of at least three pockets in said top surface adjacent said front wall including a rectangular central pocket in the center of said array and adapted to receive and provide support for a note pad, and two side pockets, one on each side of said central pocket, said side pockets being deeper than said central pocket, and each adapted to receive at least one of paper clips, rubber bands, and business cards;

at least two cylindrical pockets in said top surface and each adjacent a respective one of said side walls, said cylindrical pockets being substantially identical to each other and relatively deep in relation to said central pocket;

an upright, open topped container adapted to receive marking devices and having a cylindrical bottom sized to nest in either one of said cylindrical pockets and located in one of said cylindrical pockets; and an upright beverage container having an open top and a cylindrical bottom sized to nest in either one of said cylindrical pockets and located in the other of said cylindrical pockets.

2. The desk organizer of claim 1 wherein said pockets in said array and said cylindrical pockets define a row with one of said cylindrical pockets being at each end of said array.

3. The desk organizer of claim 2 further including an upright display panel disposed between said central pocket and said rear wall and extending upwardly from said base and adapted to mount an article to be displayed.

4. The desk organizer of claim 1 further including an upright display panel disposed between said array and said rear wall and extending upwardly from said base and adapted to mount an article to be displayed.

5. The desk organizer of claim 1 wherein each of said cylindrical pockets is located between a corresponding one of said side pockets in the array and said rear wall.

6. The desk organizer of claim 5 further including an open topped bin extending upwardly from said top surface and located between said cylindrical pockets, said central pocket and said rear wall.

7. The desk organizer of claim 1 further including an open topped bin extending upwardly from said top surface and located between said central pocket and said rear wall.

8. A desk organizer, comprising:

a base having a bottom surface adapted to rest on a generally horizontal surface, an opposite top surface, and a thickness that is relatively small in relation to the length of the periphery of the base, a front wall, a rear wall and spaced, opposed side walls extending between said front and rear walls;

an array of at least two pockets in said top surface adjacent said front wall including a rectangular pocket adapted to receive and provide support for a note pad, and a relatively deeper pocket, on one side of said shallow pocket, and adapted to receive at least one of paper clips, rubber bands, and business cards;

at least two cylindrical pockets in said top surface and each adjacent a respective one of said side walls, said cylindrical pockets being substantially identical to each other and relatively deep in relation to said shallow pocket;

an upright, open topped container adapted to receive marking devices and having a cylindrical bottom sized to nest in either one of said cylindrical pockets and located in one of said cylindrical pockets; and an upright beverage container having an open top and a cylindrical bottom sized to nest in either one of said cylindrical pockets and located in the other of said cylindrical pockets.

9. The desk organizer of claim 8 wherein said pockets define a row with one of said cylindrical pockets being at each end of said row, and an upright display panel disposed between said shallow pocket and said rear wall and extending upwardly from said base and adapted to mount an article to be displayed.

10. The desk organizer of claim 8 wherein each of said cylindrical pockets is located between a corresponding one of the pockets in said array and said rear wall, and further including an open topped bin extending upwardly from said top surface and located between said cylindrical pockets, and said shallow pocket and said rear wall.

11. A desk organizer, comprising:

a base having a bottom surface adapted to rest on a generally horizontal surface, an opposite top surface, and a thickness that is relatively small in relation to the length of the periphery of the base, a front wall, a rear wall and spaced, opposed side walls extending between said front and rear walls;

an array consisting of three pockets in said top surface adjacent said front wall including a rectangular central pocket in the center of said array and adapted to receive and provide support for a note pad, and two side pockets, one on each side of said central pocket, said side pockets being deeper than said central pocket, and each adapted to receive at least one of paper clips, rubber bands, and business cards;

at least two cylindrical pockets in said top surface and each adjacent a respective one of said side walls, said cylindrical pockets being substantially identical to each other and relatively deep in relation to said central pocket;

said pockets in said array and said cylindrical pockets defining a row with one of said cylindrical pockets being at each end of said array;

an upright, open topped container adapted to receive marking devices and having a cylindrical bottom sized to nest in either one of said cylindrical pockets and located in one of said cylindrical pockets;

an upright beverage container having an open top and a cylindrical bottom sized to nest in either one of said cylindrical pockets and located in the other of said cylindrical pockets; and an upright display panel disposed between said central pocket and said rear wall and extending upwardly from said base and adapted to mount an article to be displayed.

12. A desk organizer, comprising:

a base having a bottom wall adapted to rest on a generally horizontal surface, a top wall spaced from said bottom wall a distance that is small in relation to the length of the periphery of the base and connected to said bottom wall by a front wall, a rear wall and opposite side walls extending between said front and rear walls, said front, rear and opposite side walls further extending between said top and bottom walls;

an array of at least three pockets formed in said top wall adjacent said front wall and including a central pocket adapted to receive and provide support for a note pad, and flanked by two side pockets, one on each side of said central pocket, and adapted to receive at least one of paper clips, rubber bands and business cards, said side pockets being deeper than said central pocket;

at least two cylindrical pockets formed in said top wall, each adjacent a respective one of said side walls and located between a corresponding one of said side pockets and said rear wall and spaced from one another, said cylindrical pockets each being deeper than said central pocket;

an open topped pigeon hole bin extending upwardly from said top wall and located between said cylindrical pockets, said central pocket and said rear wall;

an upright open topped container adapted to receive at least one of marking devices, pens and pencils and having a cylindrical bottom sized to nest in either one of said cylindrical pockets and located in one of said cylindrical pockets and extending upwardly therefrom to a location above said top wall; and an upright beverage container having an open top and a cylindrical bottom sized to nest in either one of said cylindrical pockets and located in the other of said cylindrical pockets and extending upwardly therefrom to a location above said top wall.

13. A desk organizer, comprising:

a base having a bottom wall adapted to rest on a generally horizontal surface, a top wall spaced from said bottom wall a distance that is small in relation to the length of the periphery of the base and connected to said bottom wall by a front wall, a rear wall and opposite side walls extending between said front and rear walls, said front, rear and opposite side walls further extending between said top and bottom walls;

an array of at least three pockets formed in said top wall adjacent said front wall and including a central pocket adapted to receive and provide support for a note pad, and flanked by two side pockets, one on each side of said central pocket, and adapted to receive at least one of paper clips, rubber bands and business cards, said side pockets being deeper than said central pocket;

at least two cylindrical pockets formed in said top wall, each adjacent a respective one of said side walls and located between a corresponding one of said side pockets and said rear wall and spaced from one another, said cylindrical pockets each being deeper than said central pocket;

an open topped pigeon hole bin extending upwardly from said top wall and located between said cylindrical pockets, said central pocket and said rear wall, said pigeon hole bin being generally rectangular with opposed side walls facing respective ones of said cylindrical pockets, said pigeon hole bin side walls each being concave in the direction of the cylindrical pocket which it faces;

an upright open topped container adapted to receive at least one of marking devices, pens and pencils and having a cylindrical bottom sized to nest in either one of said cylindrical pockets and located in one of said cylindrical pockets and extending upwardly therefrom to a location above said top wall; and an upright beverage container having an open top and a cylindrical bottom sized to nest in either one of said cylindrical pockets and located in the other of said cylindrical pockets and extending upwardly therefrom to a location above said top wall.

* * * * *